US007330557B2

(12) United States Patent
Fischer et al.

(10) Patent No.: US 7,330,557 B2
(45) Date of Patent: Feb. 12, 2008

(54) HEARING AID, METHOD, AND PROGRAMMER FOR ADJUSTING THE DIRECTIONAL CHARACTERISTIC DEPENDENT ON THE REST HEARING THRESHOLD OR MASKING THRESHOLD

(75) Inventors: Eghart Fischer, Schwabach (DE); Volkmar Hamacher, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 626 days.

(21) Appl. No.: 10/871,434

(22) Filed: Jun. 18, 2004

(65) Prior Publication Data

US 2005/0008166 A1 Jan. 13, 2005

(30) Foreign Application Priority Data

Jun. 20, 2003 (DE) ..... 103 27 889

(51) Int. Cl.
*H04R 3/00* (2006.01)
*H04R 25/00* (2006.01)

(52) U.S. Cl. ..... 381/313; 381/92; 381/94.1

(58) Field of Classification Search ..... 381/313, 381/92, 94.1
See application file for complete search history.

(56) References Cited

U.S. PATENT DOCUMENTS

| | | | | |
|---|---|---|---|---|
| 5,524,056 | A | 6/1996 | Killion et al. | |
| 6,424,721 | B1 | 7/2002 | Hohn | |
| 2002/0057815 | A1* | 5/2002 | Killion | 381/313 |
| 2003/0169891 | A1* | 9/2003 | Ryan et al. | 381/313 |
| 2004/0047474 | A1* | 3/2004 | Vries et al. | 381/60 |

FOREIGN PATENT DOCUMENTS

| | | |
|---|---|---|
| WO | WO 00/76268 | 12/2000 |
| WO | WO 01/72085 | 9/2001 |

* cited by examiner

*Primary Examiner*—Sinh Tran
*Assistant Examiner*—Walter F Briney, III
(74) *Attorney, Agent, or Firm*—Schiff Hardin LLP

(57) ABSTRACT

For improving the directionality of a hearing aid having a microphone system formed by two or more microphones without in the process creating an increase in the microphone noise that the hearing aid wearer finds to be disturbing, the microphone system is adjusted statically or adaptively taking into account the individual rest hearing threshold and/or taking into account the individual masking threshold for the microphone noise that is produced by the microphone system. The greatest possible extent of directionality thus can be allowed, without the hearing aid wearer in the process finding the microphone noise that is produced by the microphone system to be disturbing.

14 Claims, 4 Drawing Sheets

HEARING AID, METHOD, AND PROGRAMMER FOR ADJUSTING THE DIRECTIONAL CHARACTERISTIC DEPENDENT ON THE REST HEARING THRESHOLD OR MASKING THRESHOLD

BACKGROUND OF THE INVENTION

1. Field of the Invention

The present invention relates to methods for adjustment of a hearing aid, and to a hearing aid having a microphone system with a variable directional characteristic for reception of an acoustic input signal and emission of at least one microphone output signal, having a signal processing unit and having an output transducer. The invention also relates to a programmer for a hearing aid.

2. Description of the Prior Art

Modern hearing aids make use of devices for classification of hearing situations. The transmission parameters of the hearing aid are varied automatically depending on the hearing situation. In the process, the classification may influence, inter alia, the method of operation of the interference noise suppression algorithms, and the microphone system. First, as an example, a choice is made on the basis of the identified hearing situation (discretely switched or continuously superimposed) between an omnidirectional directional characteristic (zero-order directional characteristic) and considerable directionality of the microphone system (first order or higher order directional characteristic). The directional characteristic is produced by using gradient microphones or by electrically interconnecting two or more omnidirectional microphones. Microphone systems such as these have a frequency-dependent transmission response, which is characterized by a considerable drop at low frequencies. The noise response at the microphones is, on the other hand independent of frequency. To achieve a natural sound impression, the high-pass frequency response of the microphone system has to compensate for this by amplification of the low frequencies. The noise that is present in the low frequency range is likewise also amplified in the process and in some circumstances is clearly audible in a disturbing manner, while quieter sounds are concealed by the noise. Furthermore, in the case of a microphone system which is formed from two or more omnidirectional microphones, the microphone noise is higher than that with an individual omnidirectional microphone, with the microphone noise increasing with the number of omnidirectional microphones being used.

PCT Application WO 00/76268 discloses a hearing aid having a signal processing unit and at least two microphones, which can be interconnected in order to form different order directional microphone systems, in which case the directional microphone systems themselves can be interconnected with a weighting that is dependent on the frequency of the microphone signals emitted from the microphones. The cut-off frequency between adjacent frequency bands in which different weighting of the microphone signals occurs can be adjusted as a function of the result of signal analysis.

European Application 0 942 627 discloses a hearing aid having a directional microphone system with a signal processing device, an earpiece and two or more microphones, the output signals of which can be interconnected via delay devices and the signal processing device with different weightings in order to produce an individual directional microphone characteristic. The preferred reception direction (main direction) can be adjusted individually in the directional microphone system for matching to the existing hearing situation.

U.S. Pat. No. 5,524,056 discloses a hearing aid having an omnidirectional microphone and a first order or higher order directional microphone. The amplitude of the microphone signal from the directional microphone is amplified in the low signal frequency range, and is matched to the microphone signal from the omnidirectional microphone. Both the microphone signal from the omnidirectional microphone and the microphone signal from the directional microphone are supplied to a switching unit. The omnidirectional microphone is connected to a hearing aid amplifier when the switching unit is in a first switch position, and the directional microphone is connected to the hearing aid amplifier when the switching unit is in a second switch position. The switching unit can switch automatically as a function of the signal level of a microphone signal.

One disadvantage of the known hearing aids with a directional microphone system is that, in certain hearing situations, either the directionality of the microphone system is not optimally used or a high degree of directionality leads to a clearly audible deterioration in the sound quality.

SUMMERY OF THE INVENTION

An object of the present invention is to improve the sound quality of a hearing aid with a directional microphone system.

This object is achieved by a hearing aid according to the invention having a microphone system formed by at least two microphones allowing zero order and first order directional characteristics to be produced. Preferably, more than two microphones are used, so that it is also possible to produce second order and higher order directional characteristics. Furthermore, the hearing aid has a signal processing unit for processing and frequency-dependent amplification of the microphone signal that is produced by the microphone system. The final, processed signal is emitted in the form of an acoustic output signal, by an earpiece. Other output transducers are also known, for example transducers which produce vibration.

The term "zero order directional characteristic" as used herein means an omnidirectional directional characteristic which is produced, for example, by a single omnidirectional microphone, which is not connected to any other microphones. A microphone unit having a first order directional characteristic (first order directional microphone) may be formed, for example, by a single directional microphone or by the electrical interconnection of two omnidirectional microphones. First order directional microphones allow a theoretically achievable maximum value of the directivity index (DI) of 6 dB (hyperkidney) to be achieved. In practice, with the microphones optimally positioned and the signals that are produced by the microphones being matched as well as possible, DI values of 4-4.5 dB have been obtained on the KEMAR (a standard research dummy). Second order and higher order directional microphones have DI values of 10 dB or more, which are advantageous, for example, in order to allow speech to be understood better. If a hearing aid contains a microphone system with, for example, three omnidirectional microphones, then microphone units with zero order to second order directional characteristics can be produced at the same time on this basis by suitable interconnection of the microphones.

A single omnidirectional microphone intrinsically represents a zero order microphone unit. If, when two omnidirectional microphones are used, the microphone signal from one microphone is delayed, inverted and added to the microphone signal from the other microphone, then this results in a first order microphone unit. If the microphone signal from one microphone unit in two first order microphone units is once again delayed, inverted and added to the microphone signal from the second first-order microphone unit, then this results in a microphone unit with a second order directional characteristic. This allows microphone units of any desired order to be produced, depending on the number of omnidirectional microphones.

If a microphone system has microphone units of different orders, then it is possible to switch between different directional characteristics, for example by connection or disconnection of one or more microphones. Furthermore, any desired mixed forms between the directional characteristics of different order can also be produced by suitable electrical interconnection of the microphone units. For this purpose, the microphone signals from the microphone units are weighted differently and are added before they are processed further and amplified in the hearing aid signal processing unit. This makes it possible to provide a continuous, smooth transition between different directional characteristics, thus making it possible to avoid disturbing artifacts during switching.

In many everyday situations, it is desirable for a hearing aid to have a high degree of directionality. It is thus possible, for example, to understand the words of a conversation partner better during a conversation or, in a hearing situation with interference noise from the sides, to largely suppress this interference noise. However, a greater degree of directionality also increases the microphone noise caused by the microphone system. A compromise therefore must always be found between the intensity of the directionality and the maximum acceptable microphone noise.

In the hearing aid according to the invention, the maximum permissible microphone noise is matched to the individual hearing loss of the hearing aid wearer by, when the directional characteristic is changed, permitting microphone noise only to the extent that it is not found to be disturbing by the hearing aid wearer. In this case, the microphone noise is found to be particularly disturbing, particularly when the output signals from the hearing aid are quiet, since, when the output signals are quiet, the useful signal does not conceal (mask) the noise. In contrast, when the output signal from the hearing aid is loud, the microphone noise is concealed and is thus inaudible. Thus, in situations where the signal level of the microphone signal that is produced by the microphone system is relatively high, there is no need to restrict the directionality, owing to the psycho-acoustic concealment of the microphone noise by the loud input signal.

In order to avoid sacrificing directionality unnecessarily, but to utilize the directionality optimally on an individual basis, in an embodiment of the invention the individual rest hearing threshold of the hearing aid wearer also is taken into account in the directionality setting.

For this purpose, the rest hearing threshold of the hearing aid wearer is first determined as a function of the frequency of a test signal which is supplied to the hearing of the hearing aid wearer. The microphone noise which originates from the microphone system and is supplied to the hearing of the hearing aid wearer can be calculated quite accurately, with respect to the frequency, on the basis of actual hearing aid settings which, in particular, relate to the signal transmission response of the hearing aid, and to the microphone system. As an alternative to the calculation process, it is likewise possible to measure the microphone noise at the given hearing aid settings as a function of the frequency. A comparison with the previously measured individual rest hearing threshold of the hearing aid wearer now indicates whether the microphone noise is above the rest hearing threshold, at least in certain frequency ranges, and will thus be perceived by the hearing aid wearer. According to the invention, as high a degree of directionality as possible is then set for the frequencies which can be transmitted by means of the hearing aid, without the microphone noise that is caused by the microphone system in the process exceeding the rest hearing threshold.

In one embodiment of the invention, the directional characteristic of the microphone system is adjusted such that, although the microphone noise which is caused by the microphone system and is supplied to the hearing of the hearing aid wearer is above the rest hearing threshold, at least in a specific frequency range, it does not, however, exceed a level of noise which is individually regarded as being tolerable by the hearing aid wearer. In particular, by varying the directional characteristic as a function of the frequency of an acoustic input signal, it is possible to set the microphone noise such that it matches the rest hearing threshold or the level of noise which is regarded as being tolerable over the entire frequency range which can be transmitted by the hearing aid.

In a further embodiment of the invention the directional microphone system is adjusted so as to be matched to the current environmental system during operation of the hearing aid. Particularly in the case of a microphone signal with a high signal level, a higher degree of directionality is permissible than would be the case if only the rest hearing threshold were taken into account. For this purpose, however, it is necessary to measure the signal level of the microphone signal that is produced by the microphone system. The directionality is optimized, in particular, when the individual masking threshold of the hearing aid wearer is determined with respect to the microphone noise. This means the signal level of a component in the output signal of the microphone system is masked (suppressed), which is caused by an acoustic input signal at which the component of the microphone noise in this output signal, and can thus no longer be perceived by the hearing aid wearer. The masking threshold is dependent on the frequency and the signal level of the microphone noise, and indicates which microphone signals are suitable for concealing the microphone noise. The degree of directionality of the microphone system is then varied as a function of the frequency of an acoustic input signal in order to achieve as high a directionality as possible without the microphone noise in the process exceeding the masking threshold. Analogously to the rest hearing threshold, a degree of microphone noise which is regarded individually as being tolerable by the hearing aid wearer also can be permitted in this case, which means that the directionality is set such that the microphone noise must not exceed the masking threshold, even by a specific amount, at least in one specific frequency range. In principle, it is possible during the programming of the hearing aid to define any desired function which indicates the value by which the microphone noise could exceed or else be below the rest hearing threshold, as a function of the frequency. In practice, however, a constant value (for example 5 dB above the rest hearing threshold as measured in this frequency range) is defined for the maximum permissible microphone noise, at least for one specific frequency range (for example from 2 kHz to 4 kHz).

The process of adjustment of the directionality of the hearing aid according to the invention as a function of the rest hearing threshold or of the masking threshold can be carried out by the acoustician, for example while matching the hearing aid to the individual hearing loss of a hearing aid wearer. This matching process, however, is advantageously carried out automatically by the programmer, controlled by appropriate programming software. Audiometric data relating to the hearing aid wearer is used as input variables for the calculation, in particular the rest hearing threshold or the masking threshold, characteristic values of the hearing aid, and the hearing aid settings, in order to compensate for the individual hearing loss of the hearing aid wearer. The programmer then uses this data to calculate values of the adjustment parameters which relate to the setting of the directionality as a function of the frequency. During the process of setting the directionality as a function of the masking threshold, the directionality is additionally adjusted as a function of the signal level of the output signal which is supplied to the hearing of the hearing aid wearer. The programmer calculates adjustment parameters for this purpose as well, which are transmitted to the hearing aid and control the directionality of the microphone system as a function of this signal level during continuous operation of the hearing aid.

The invention can be used for all known hearing aid types having an adjustable directional microphone, for example for hearing aids which can be worn behind the ear, hearing aids which can be worn in the ear, implantable hearing aids or pocket hearing aids. Furthermore, the hearing aid according to the invention may be part of a hearing aid system which has two or more appliances for use by a hearing-impaired person, for example part of a hearing aid system having two hearing aids that are worn on the head for binaural supply, or part of a hearing aid system having one appliance which can be worn on the head, and a processor unit which can be worn on the body.

DESCRIPTION OF THE PREFERRED EMBODIMENTS

Figure 1:
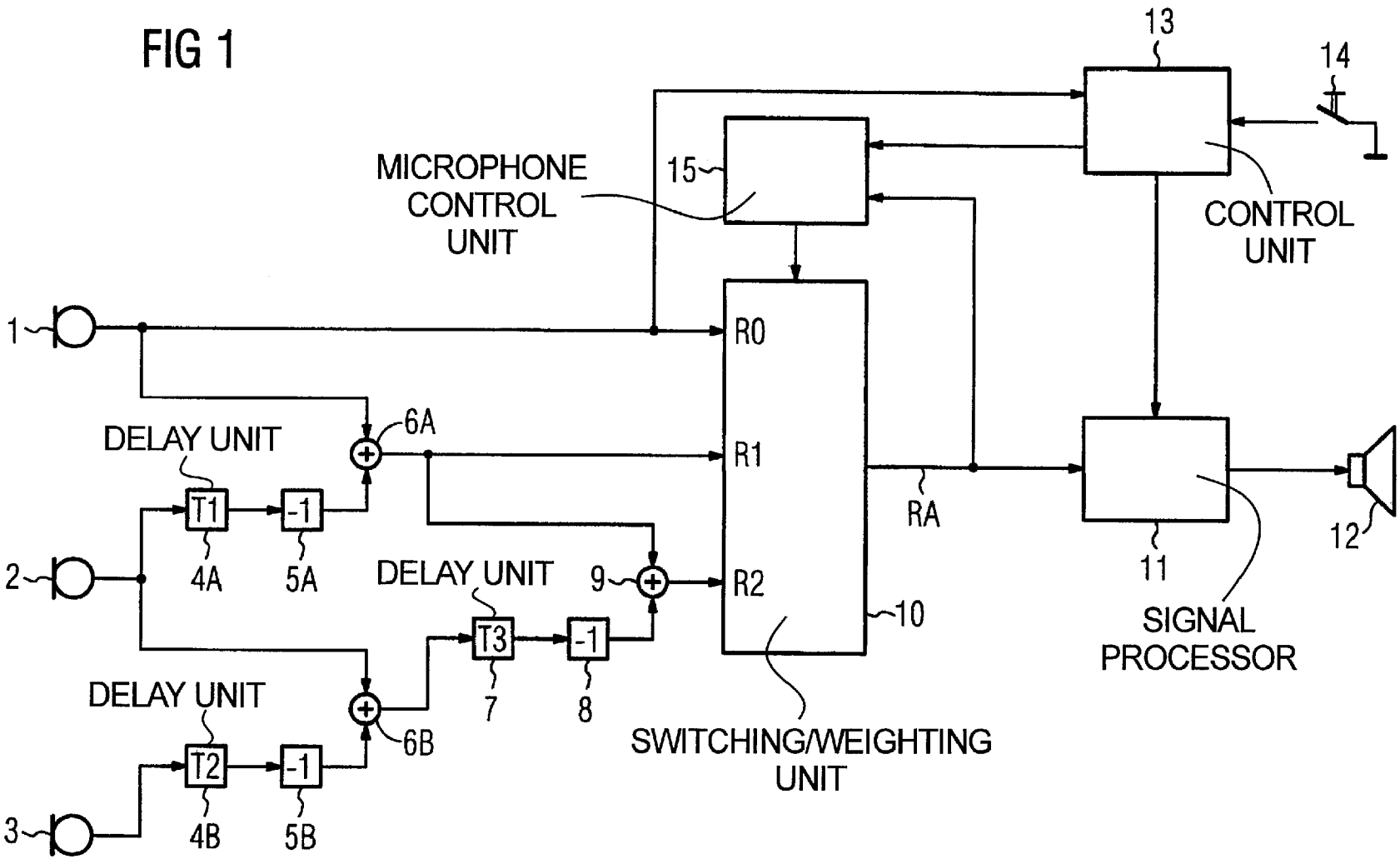
FIG. 1 shows a hearing aid according to the invention, having a directional microphone system formed by three omnidirectional microphones.

FIG. 1 shows a basic circuit diagram of a hearing aid having a directional microphone system according to the invention. The microphone system has three omnidirectional microphones 1, 2 and 3. The microphone signal which originates from the microphone 2 is delayed in a delay unit 4A, is inverted by an inverter 5A and is added in an adder 6A to the microphone signal R0 which originates from the microphone 1. The two omnidirectional microphones 1 and 2 thus form a directional microphone 1, 2 with a first order directional characteristic, from which the microphone signal R1 originates. In the same way, the microphone signal which originates from the microphone 3 is delayed in a delay unit 4B, is inverted by an inverter 5B and is added in an adder 6B to the microphone signal which originates from the microphone 2. The microphones 2 and 3 thus also form a directional microphone system 2, 3 with a first order directional characteristic, whose microphone signal is produced at the output of the adder 6B. If the microphone signal which originates from the directional microphone system 2, 3 is in turn delayed in a delay unit 7, and is inverted in an inverter 8 and is added in an adder 9 to the microphone signal R1 which originates from the directional microphone system 1, 2, then the microphones 1, 2 and 3 form a directional microphone system 1, 2, 3 with a second order directional characteristic, whose microphone signal R2 is produced at the output of the adder 9. The three microphone signals R0, R1 and R2 are, finally, supplied to a switching/weighting unit 10, in which it is possible to switch between the different microphone signals, or in which the different microphone signals R0, R1 and R2 are weighted and added. The resultant microphone output signal RA emitted at the output of the unit 10 is, finally, supplied to a signal processor 11, in which the further processing and frequency-dependent amplification of the microphone output signal RA are carried out in order to compensate for the individual hearing loss of a hearing aid wearer. Finally, the processed microphone signal is converted to an acoustic signal by means of an earpiece 12 in order to be emitted into an auditory channel of the hearing aid wearer.

Modern hearing aids can be matched to different hearing situations in a particular manner. For this purpose, the hearing aid in the exemplary embodiment has a control unit 13 in which various parameter sets, so-called hearing programs, can be stored and can be called in order to control the signal processing in the hearing aid. It is possible to switch between the various hearing programs by means of a program selection key 14. Furthermore, the hearing aid has automatic situation identification, by means of which the hearing aid parameters which relate to signal processing can be adapted during operation of the hearing aid. For signal analysis, the control unit 13 is supplied with the microphone signal which originates from the omnidirectional microphone 1. The directional characteristic of the microphone system is also matched to the identified environmental situation and/or to the selected hearing program, with a microphone control unit 15 being provided in the exemplary embodiment, which is likewise controlled by the control unit 13. Thus, depending on the identified environmental situation and/or the selected hearing program, it is thus possible for the microphone control unit 15 to switch between directional microphone systems with a zero, first or second order directional characteristic, or to differently weight and add the microphone signals which originate from the different order directional microphones, controlled by the microphone control unit 15.

The hearing aid according to the exemplary embodiment provides for the directional characteristic to be adjusted taking into account the individual rest hearing threshold of a hearing aid wearer. This is determined by a hearing test, which is generally carried out by a hearing aid acoustician. Furthermore, in the case of the hearing aid according to the exemplary embodiment, the microphone noise is determined for different directional characteristics, for example being measured or being calculated taking into account the microphone characteristic data, the various interconnections of the microphones as well as the signal processing in the hearing aid for the respective hearing aid settings. The directionality of the hearing aid is then set as a function of the frequency, of the rest hearing threshold and of the microphone noise at the respective frequency. If, by way of example, the individual rest hearing threshold of the hearing aid wearer is 30 dB SPL in one frequency range, then the directional characteristic is adjusted such that the microphone noise which is produced by the microphone system and is supplied to the hearing of the hearing aid wearer is in the same order of magnitude as this rest hearing threshold, such that as high a degree of directionality as possible is achieved without in the process, without the microphone noise which is produced by the microphone system being found to be disturbing by the hearing aid wearer. If the rest hearing threshold of the hearing aid wearer is, for example, 50 dB SPL in another frequency range, then a higher degree of directionality can be allowed in this frequency range, for example a second order directional characteristic, without the hearing aid wearer perceiving the microphone noise in this case.

The process of adjustment of the hearing aid is thus intended to allow as high a degree of directionality as possible without the microphone noise produced by the microphone system and taking into account the current hearing aid settings in the process, being above the individual rest hearing threshold of the hearing aid wearer.

Another strategy for hearing aid adjustment is to prevent the microphone noise that can be perceived by the hearing aid wearer from exceeding a specific level. The microphone system then can be adjusted such that the microphone noise caused by the microphone system in the output signal from the hearing aid does not, at most, exceed the rest hearing threshold of the hearing aid wearer by more than this same amount. In this case, this degree of microphone noise which is regarded as being tolerable by the hearing aid wearer may relate to the entire frequency range which can be transmitted by the hearing aid, or may be restricted to only a specific frequency range.

In a further development of the invention, the microphone control unit 15 also is supplied with the output signal from the control unit 10, and thus with the microphone output signal RA which is intended for further processing. This has the advantage that, in addition to the individual rest hearing threshold, it is also possible to take account of the signal level of this microphone signal in the adjustment of the directional characteristic. This is because the microphone noise is found to be disturbing only when the signal levels of the microphone output signal RA are relatively low. If the level of this microphone output signal RA is relatively high, the microphone noise represents only a small proportion of this signal, and the majority of the microphone output signal RA is governed by the acoustic input signal. However, this means that the microphone noise case suppressed (masked) by the acoustic input signal, and thus is not perceived by the hearing aid wearer. A higher degree of directionality thus can be allowed in a hearing situation such as this than would be the case if only the rest hearing threshold were taken into account. The greatest possible directionality of the microphone system thus can be set for a microphone output signal RA with a very high signal level, without the microphone noise in the process being found to be disturbing by the hearing aid wearer. Matching of the directional characteristic of the microphone system to the rest hearing threshold is thus particularly important for microphone output signals RA with a low signal level, since, in these signals, the microphone noise is stronger in the microphone signal, and thus may be found to be disturbing.

Further optimization of the directional microphone system is achieved by determining the individual masking threshold for the microphone noise for the hearing aid wearer. The directionality then can be adjusted as a function of the frequency of the microphone signals R0, R1 and R2 which originate from the microphones 1-3, such that the maximum directionality is always set, at which the microphone noise is just still suppressed. In the case of a very quiet acoustic input signal or when there is no acoustic input signal, essentially only the microphone signal R0 which originates from the omnidirectional microphone 1 is automatically passed on to the signal processing unit 11. As the signal level in the microphone signal increases, switching takes place in steps to higher order directional characteristics, or the weight of the microphone signal R1 or R2 in comparison to R0 is increased continuously.

In the same way as in the case of the rest hearing threshold, a specific amount of microphone noise may also be regarded as being tolerable by the individual hearing aid wearer when the masking threshold is taken into account. The directional characteristic of the microphone system then is set such that this amount of microphone noise is still perceptible by the hearing aid wearer, either over the entire frequency range which can be transmitted or only in at least one frequency band.

In the exemplary embodiment shown in FIG. 1, the microphone control unit 15 is supplied with the microphone output signal RA in order to set the directionality of the microphone system such that the microphone noise which is supplied to the hearing of the hearing aid wearer is below the rest hearing threshold, and is concealed by a wanted signal. Since the feedback is thus provided before the actual signal processing in the hearing aid by means of the signal processing unit 11, the microphone control unit 15 is additionally also supplied with the current control parameters for a control unit 13, so that the further processing of the microphone output signal RA can be taken into account by the signal processing unit 11. Alternatively, the microphone control unit 15 could also be supplied with the output signal from the signal processing unit 11.

The signal processing in the hearing aid according to the exemplary embodiment may be carried out using analog, digital or a hybrid circuit technology. Furthermore, the signal processing can be carried out in parallel in adjacent frequency bands (channels). The directional characteristic of the microphone system is also preferably adjusted in frequency bands.

Figure 2:
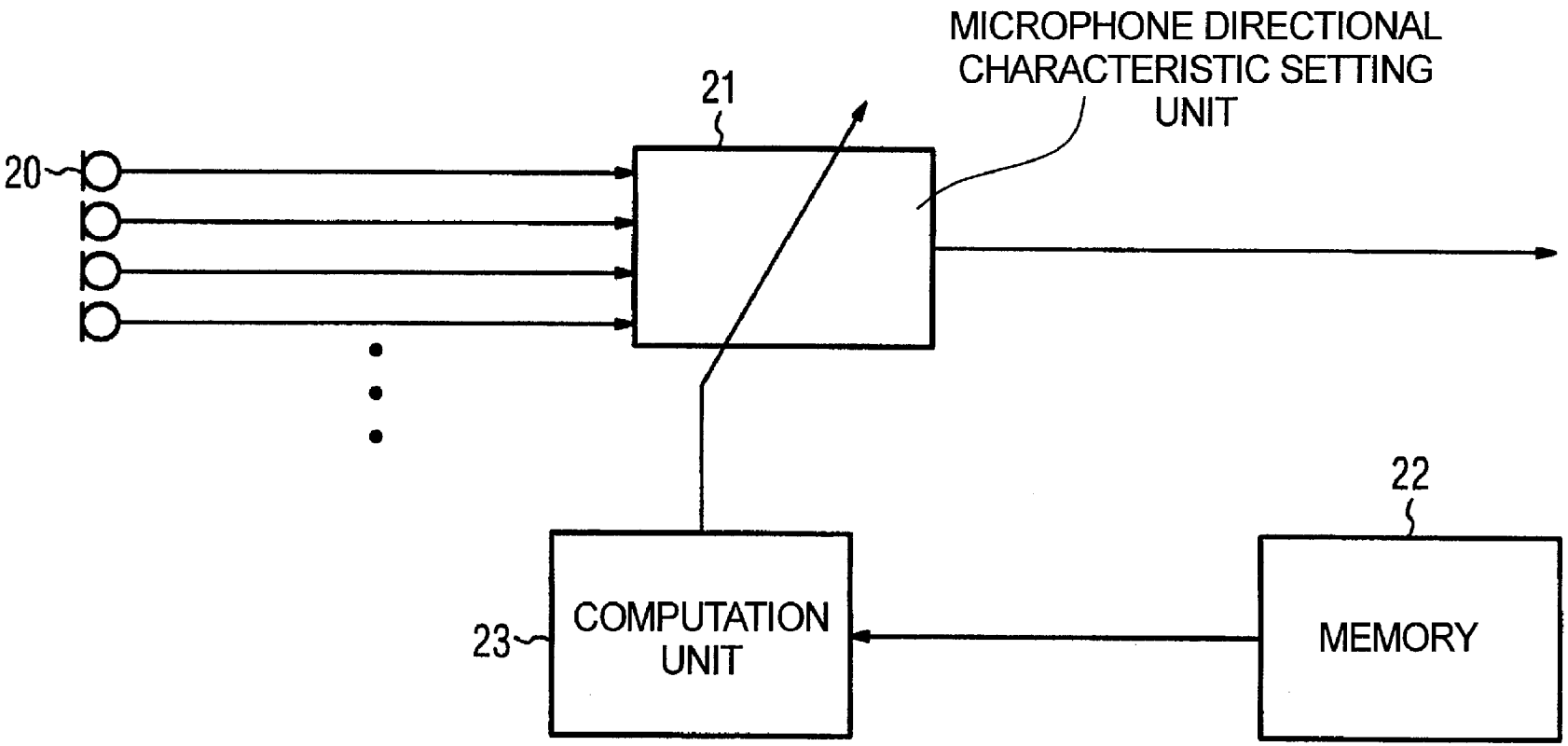
FIG. 2 is a block diagram for the adjustment of a directional microphone system taking into account an individual rest hearing threshold, in accordance with the invention.
Figure 3:
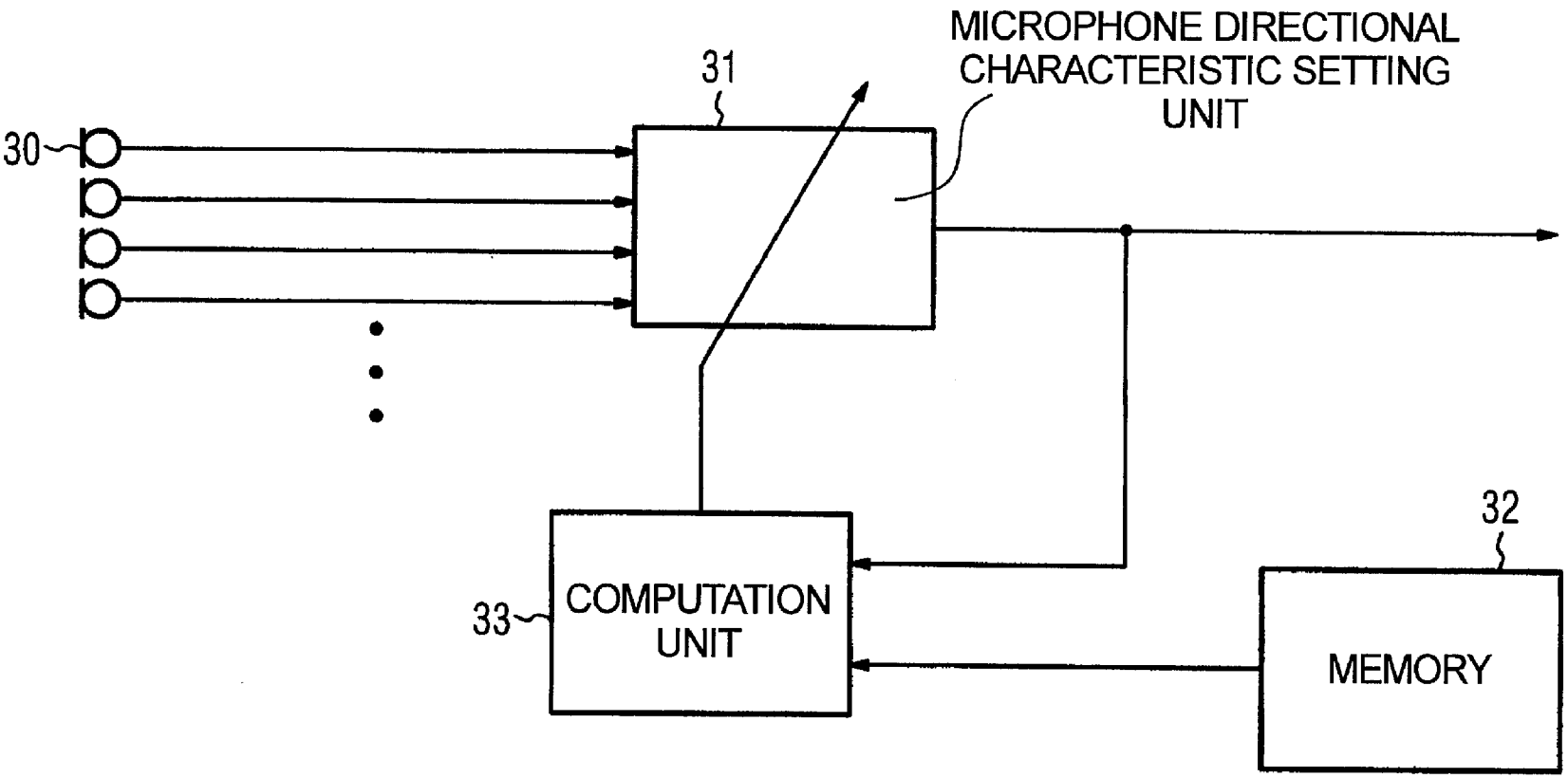
FIG. 3 is a block diagram for adjustment of a directional microphone, taking into account the individual masking threshold in accordance with the invention.
Figure 4:
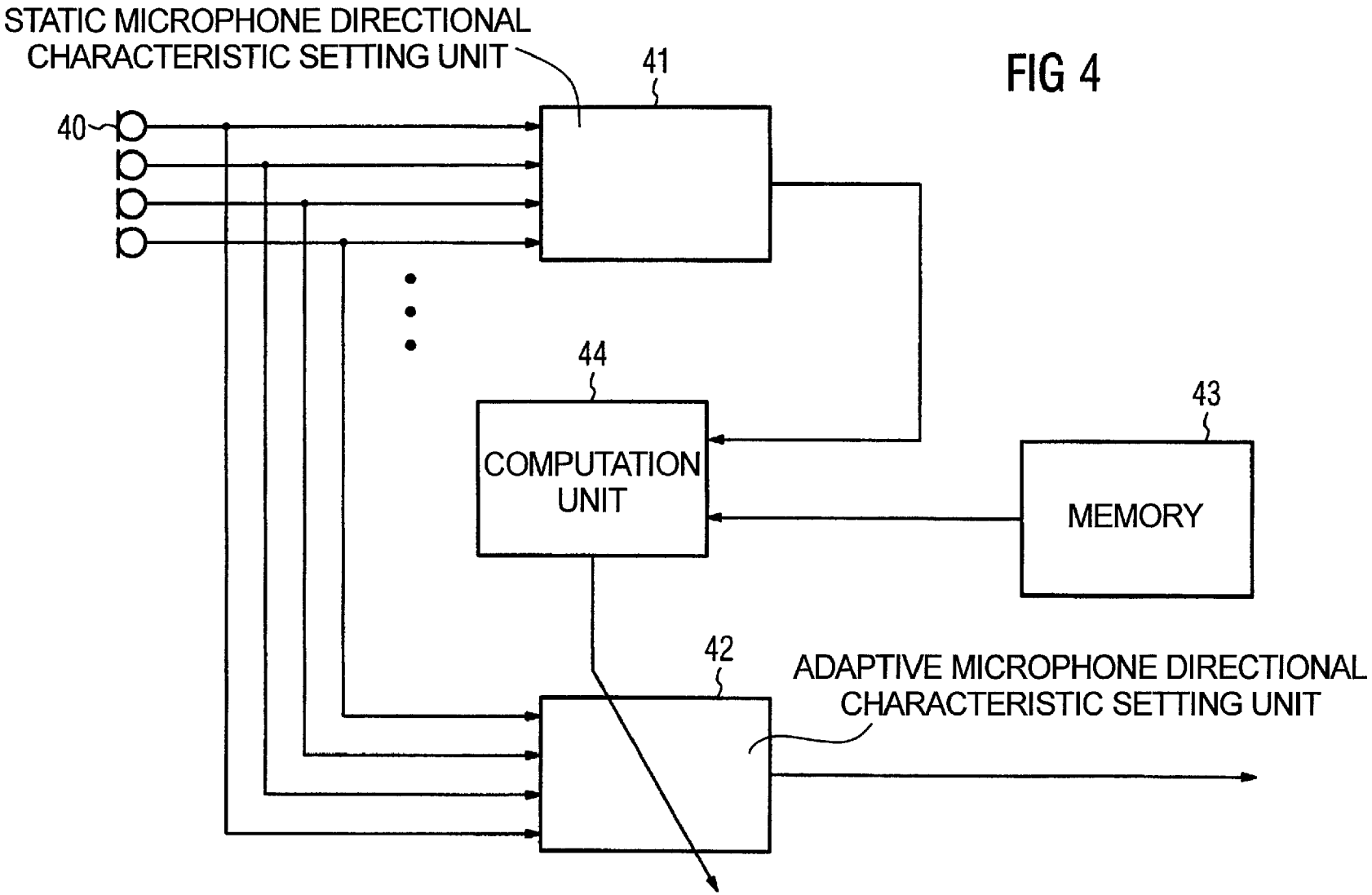
FIG. 4 is a block diagram for adjustment of a microphone system, taking into account the individual masking threshold as well as the output signal that is produced by the microphone system, in accordance with the invention.

The basic steps for adjustment of a hearing aid according to the invention are illustrated in FIGS. 2 to 4 and will be described once again in a generalized form. FIG. 2 is a block diagram for adjustment of a directional microphone system taking into account an individual rest hearing threshold. The microphone system of the hearing aid comprises a microphone array 20 with two or more microphones, each of which emits a microphone signal. To adjust the directional characteristic, the microphone signals are supplied to a setting unit 21. At its signal output, this setting unit 21 produces a microphone signal, which is intended for further processing in the hearing aid. The goal of the hearing aid adjustment process is to achieve as high a degree of directionality as possible without in the process allowing the microphone noise to rise such that this is perceived by a hearing aid wearer as being disturbing.

To achieve a microphone system setting such as this, the individual rest hearing threshold of the hearing aid wearer is first determined by means of a test device as a function of the frequency of a test signal which is supplied to the hearing of the hearing aid wearer, and this is stored in a memory device 22. The hearing aid threshold may be measured by a hearing aid acoustician, but the measurement process may also be carried out by a suitable measurement device (PC with appropriate software), or by the hearing aid wearer himself or herself, using a hearing aid with an integrated tone generator. If the individual rest hearing threshold of a hearing aid wearer as a function of the frequency is known, then the required amplification for quiet input signals can also be determined from this as a function of the frequency by the hearing aid, in order to compensate for the hearing loss. The hearing loss, however, generally is not compensated for completely by the hearing aid, but is reduced only by, for example, 50% with respect to the rest hearing threshold of someone with normal hearing. The gain required for quiet input signals in turn makes it possible to determine the microphone noise supplied to the hearing of the hearing aid wearer when the input signals are quiet, or when there is no acoustic input signal.

To determine the microphone noise as a function of the frequency and different settings of the directional characteristic, it is either possible to carry out measurements on the hearing aid, or to calculate the respective microphone noise on the basis of hearing aid characteristic data as well as microphone characteristic data. Taking account of the characteristic data obtained in this way, an optimized directional characteristic of the microphone array is now determined as a function of the frequency of an acoustic input signal and of the individual rest hearing threshold of the hearing aid wearer at the respective frequency, with the values of the adjustment parameters of the hearing aid and, in particular, of the setting unit 21 for setting this directional characteristic itself for this purpose being calculated and being set on the hearing aid. The calculation process is carried out in a computation device 23, which is preferably in the form of a programmer or PC with appropriate software, and which has a memory device 22.

The calculated parameters are then transmitted to the hearing aid. The computation unit 23 may alternatively be arranged within the hearing aid. The hearing aid, and in particular the unit 21, are set such that the microphone noise which is supplied to the hearing of the hearing aid wearer at least approximately matches this person's rest hearing threshold, or at least does not exceed it. Furthermore, the directionality of the microphone array can also be adjusted such that the resultant microphone noise exceeds the rest hearing threshold of the hearing aid wearer by an extent which can be tolerated by this person, at least in a specific frequency range. This amount preferably can be varied freely, as a function of the frequency.

A setting of the directionality of the microphone system which is better than that in the exemplary embodiment shown in FIG. 2 can be achieved by setting the adjustments of the microphone array as shown in FIG. 3. In this case as well, the microphone signals from a number of microphones 30 are first of all supplied to a setting unit 31, in order to adjust the directional characteristic. In contrast to the situation in the previous exemplary embodiment, the adjustment process is in this case not carried out statically, for example once during the matching of the hearing aid by the acoustician, but is carried out adaptively throughout continuous operation of the hearing aid. The microphone signal that is produced by the microphone system or a signal which is derived from this microphone signal is likewise taken into account for adjustment of the directionality. If the microphone signal has a high signal level in at least one specific frequency range, then more microphone noise, and thus a greater degree of directionality, can be tolerated at least in this frequency range. The directionality is then increased, at least in this frequency range, until the proportion of the microphone noise in the output signal is just still concealed by the proportion of the output signal originating from the acoustic input signal, or the maximum directionality is reached. This ensures that the maximum directionality at which the microphone noise is not found to be disturbing is always set.

The masking threshold for the microphone noise is also determined on the basis of test signals which are supplied to the hearing of the hearing aid wearer, for example while the hearing aid is being matched. Sinusoidal signals, white noise or a noise which is similar to the microphone noise is or are preferably used as test signals. Data relating to the measured, individual masking threshold is then stored as a function of the frequency in a memory device 32 in the hearing aid. A computation device 33 uses this data and the output signal from the setting unit 31 to adaptively calculate an optimized setting for the circuit unit 31, so that the directionality is set to be as high as possible without any microphone noise being perceived by the hearing aid wearer. In this exemplary embodiment as well, an alternative embodiment can be provided by adjusting the directionality of the microphone array such that the resultant microphone noise exceeds the rest hearing threshold of the hearing aid wearer by an extent which can be tolerated by this person, at least in a specific frequency range. This level preferably also is freely variable as a function of the frequency.

A further embodiment for adjustment of the directionality of a microphone system having two or more microphones 40 is shown in FIG. 4. In this case as well, the adjustment process is carried out as in the case of the previous embodiment adaptively and taking into account the individual masking threshold. In contrast to the exemplary embodiment shown in FIG. 3, however, the output signal from the setting unit 41 which is intended to be processed further in a signal processing unit in the hearing aid is, however, ignored in this case. Instead of this, the microphone system has a second circuit unit 42, which likewise receives the microphone signals that are produced by the omnidirectional microphones 40, and which produces the output signal from the microphone system that is intended for further processing. In this case, the first setting unit 41 is adjusted statically, that is to say the adjustment process is in any case carried out during the matching of the hearing aid, but not during normal operation. The output signal from this setting unit 41 is then used, together with the data relating to the individual masking threshold of the hearing aid wearer, which is stored in a memory device 43 in the hearing aid, to control the second circuit unit 42. If it is found, for example, that, with the static settings of the static setting unit 41, the microphone noise in the present hearing situation would not be concealed by the acoustic input signal, then the adaptive setting unit 42 can set a higher degree of directionality. The adjustment parameters for the setting unit 42 are in this case determined by means of the computation device 44 during continuous operation of the hearing aid from the profile of the masking threshold that is stored in the memory device 43, as a function of the frequency and of the signal levels of the microphone noise and of the wanted signal, as well as the output signal from the setting unit 41. In particular, this calculation takes account of the degree of concealment, that is to say the difference between the signal level of the microphone noise and the signal level of the component of the output signal from the setting unit 41 that is caused by the acoustic input signal. If there is a major difference between these two signal levels, the computation device 44 can cause the setting unit 42 to produce a relatively major increase in the directionality in comparison to the directionality produced by the setting unit 41. An advantage of this embodiment is that there is no need for any feedback loop, as in the case of the previous exemplary embodiment.

As an alternative to the masking threshold that is measured individually at the wearer of the hearing aid to be adjusted, the process of adaptive adjustment of a directional microphone system according to the invention may also be based on a masking model, derived from measurements on a large number of subjects. Data relating to this general masking model are stored in the memory devices 32 and 43, respectively, in the exemplary embodiments shown in FIGS. 3 and 4, and this masking model generally likewise produces good results for the calculation of adjustment parameters for the directional microphone system. There is thus no need for the complex measurement of the individual masking threshold.

In summary, for a hearing aid having a microphone system which comprises two or more microphones, the goal of the invention is to improve the directionality without in the process causing a hearing aid wearer to perceive an increase in the microphone noise that is found to be disturbing. To achieve this, the inventive hearing aid has a microphone system that is adjusted statically or adaptively (dynamically) taking into account the individual rest hearing threshold, or taking into account the individual masking threshold for the microphone noise that is produced by the microphone system. The greatest possible degree of directionality thus also can be allowed, without the hearing aid wearer in the process finding the microphone noise that is produced by the microphone system to be disturbing.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for adjusting a directional characteristic of a hearing aid having a microphone system with a variable directional characteristic for receiving an acoustic input signal and emitting at least one microphone output signal that is processed to form an acoustic output signal, comprising the steps of:

(a) determining a rest hearing threshold of a hearing aid wearer as a function of a signal frequency of a test signal heard by the hearing aid wearer; and (b) adjusting the directional characteristic of the microphone system as a function of a frequency of the acoustic input signal and the rest hearing threshold.

2. A method as claimed in claim 1 wherein step (b) comprises adjusting the directional characteristic of the microphone system as a function of the frequency of the acoustic input signal and a signal level of said microphone output signal for matching a signal level of microphone noise produced by said microphone system in said microphone output signal to said rest hearing threshold at said frequency.

3. A method as claimed in claim 1 wherein step (b) comprises adjusting the directional characteristic of said microphone system as a function of the frequency of the acoustic input signal and a signal level of the microphone output signal to cause a signal level of microphone noise produced by said microphone system in said microphone output signal to differ by an adjustable value from said rest hearing threshold at said frequency.

4. A method as claimed in claim 1 comprising automatically determining parameters for adjusting the directional characteristic of the microphone system as a function of the frequency of the acoustic input signal and said rest hearing threshold.

5. A method for adjusting a directional characteristic of a hearing aid having a microphone system with a variable directional characteristic for receiving an acoustic input signal and emitting at least one microphone output signal that is processed to form an acoustic output signal, comprising the steps of:

(a) determining a masking threshold for a hearing aid wearer for masking microphone noise produced by said microphone system as a function of a signal frequency and a signal level of a test signal heard by said hearing aid wearer;

(b) determining a signal level of a microphone output signal from said microphone system as a function of a frequency of the microphone output signal; and (c) adjusting the directional characteristic of said microphone system as a function of the frequency of the microphone output signal, said masking threshold, and said signal level of said microphone output signal.

6. A method as claimed in claim 5 wherein step (b) comprises adjusting the directional characteristic of the microphone system as a function of the frequency of the acoustic input signal and a signal level of said microphone output signal for matching a signal level of microphone noise produced by said microphone system in said microphone output signal to said masking threshold at said frequency.

7. A method as claimed in claim 5 wherein step (b) comprises adjusting the directional characteristic of said microphone system as a function of the frequency of the acoustic input signal and a signal level of the microphone output signal to cause a signal level of microphone noise produced by said microphone system in said microphone output signal to differ by an constant value from said masking threshold at said frequency.

8. A method as claimed in claim 5 comprising automatically determining parameters for adjusting the directional characteristic of the microphone system as a function of the frequency of the acoustic input signal and said masking threshold.

9. A hearing aid comprising:

a microphone system having a variable directional characteristic for receiving an acoustic input signal and producing a microphone output signal therefrom;

circuitry for adjusting said directional characteristic of said microphone system for substantially matching a signal level of microphone noise produced at a frequency by the microphone system to a rest hearing threshold at said frequency for a hearing aid wearer;

a signal processor for processing said microphone output signal to obtain a processed signal; and an output transducer for converting said processed signal into an audio output signal.

10. A hearing aid comprising:

a microphone system having a variable directional characteristic for receiving an acoustic input signal and producing a microphone output signal therefrom;

a circuit for adjusting the directional characteristic of said microphone system as a function of a frequency of said microphone output signal for causing a signal level of microphone noise produced by said microphone system at said frequency to differ by an adjustable value from a rest hearing threshold at said frequency for a hearing aid wearer;

a signal processor for processing said microphone output signal to obtain a processed signal; and an output transducer for converting said processed signal into an audio output signal.

11. A hearing aid comprising:

a microphone system having a variable directional characteristic for receiving an acoustic input signal and producing a microphone output signal therefrom;

a circuit for adjusting the directional characteristic of the microphone system as a function of a frequency of the microphone output signal for substantially matching a signal level of microphone noise produced by the microphone system at said frequency to a masking threshold at said frequency for a hearing aid wearer.

12. A hearing aid comprising:

a microphone system having a variable directional characteristic for receiving an acoustic input signal and producing a microphone output signal therefrom;

a circuit for adjusting the directional characteristic of said microphone system as a function of a frequency of said microphone output signal for causing a signal level of microphone noise produced by said microphone system at said frequency to differ by a constant value from a masking threshold at said frequency for a hearing aid wearer;

a signal processor for processing said microphone output signal to obtain a processed signal; and an output transducer for converting said processed signal into an audio output signal.

13. A programmer for programming hearing aids having a microphone system with a directional characteristic, said programmer comprising:

a memory containing an individual rest hearing threshold of a hearing aid wearer as a function of a frequency of a test signal heard by said hearing aid wearer; and a computation unit for calculating parameters for adjusting the directional characteristic of said microphone system as a function of said threshold and frequency.

14. A programmer for programming hearing aids having a microphone system with a directional characteristic, said programmer comprising:

a memory containing an individual masking threshold of a hearing aid wearer as a function of a frequency of a test signal heard by said hearing aid wearer; and a computation unit for calculating parameters for adjusting the directional characteristic of said microphone system as a function of said threshold and frequency.

* * * * *